US005537898A

United States Patent [19]

Kerr

[11] Patent Number: 5,537,898

[45] Date of Patent: Jul. 23, 1996

[54] KEY HOLDING TOOL FOR LOCKSMITHS

[76] Inventor: John W. Kerr, 3434 NE. 130th, Portland, Oreg. 97230

[21] Appl. No.: 399,137

[22] Filed: Mar. 6, 1995

[51] Int. Cl.[6] ..... B25B 7/02

[52] U.S. Cl. ..... 81/426; 81/421; 81/418

[58] Field of Search ..... 81/426, 424.5, 81/418, 421, 426.5, 186; 269/47, 96, 54.4, 54.5

[56] References Cited

U.S. PATENT DOCUMENTS 1,537,766 5/1925 Greene ..... 81/426
2,590,031 3/1952 Petersen ..... 81/418
3,336,825 8/1967 Cashion ..... 81/426
4,136,589 1/1979 Kerr ..... 81/425

*Primary Examiner*—Willis Little
*Attorney, Agent, or Firm*—Eugene M. Eckelman

[57] ABSTRACT

First and second jaws are arranged to hold a key for fitting the key to a lock. A first jaw includes an anvil surface and a second jaw includes a lateral cutting lip that is arranged to cut slightly into the key when the latter is clamped securely in the tool whereby to hold a key firmly in a rigid extension of the tool. The second jaw includes an integral post that fits in the usual aperture in the head of the key to help stabilize the key in the tool. Also, the tool includes an abutting edge that forms a stop in the inserted position of the key in the tool.

2 Claims, 1 Drawing Sheet

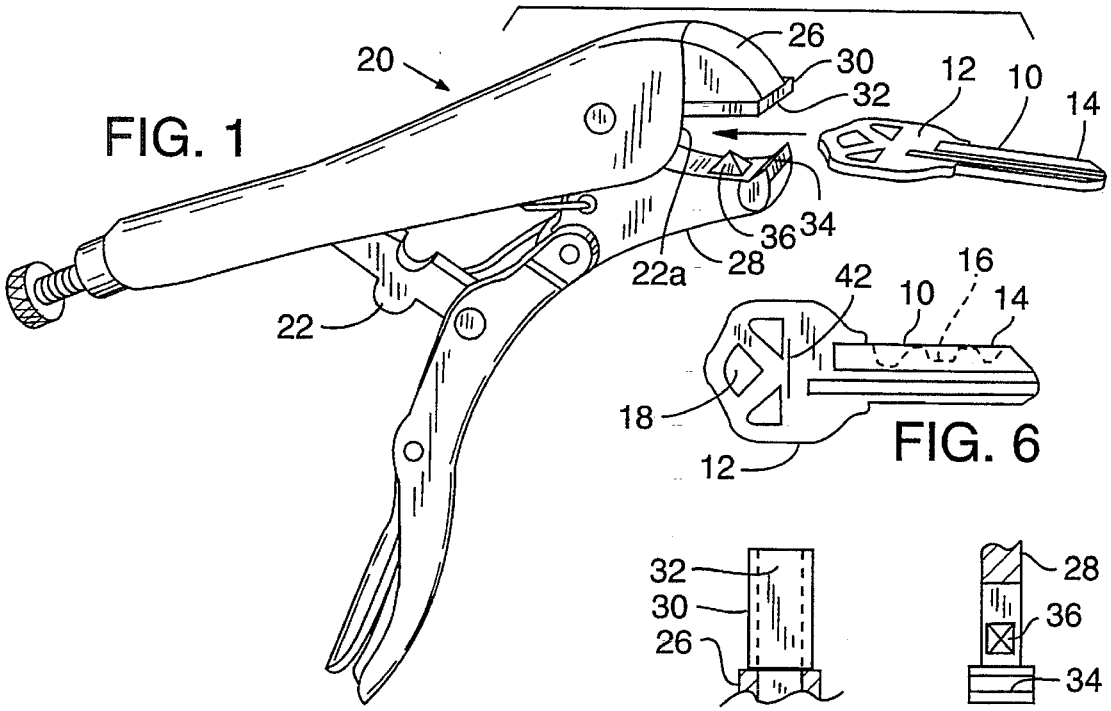
FIG. 1
FIG. 6
FIG. 4
FIG. 5
FIG. 2
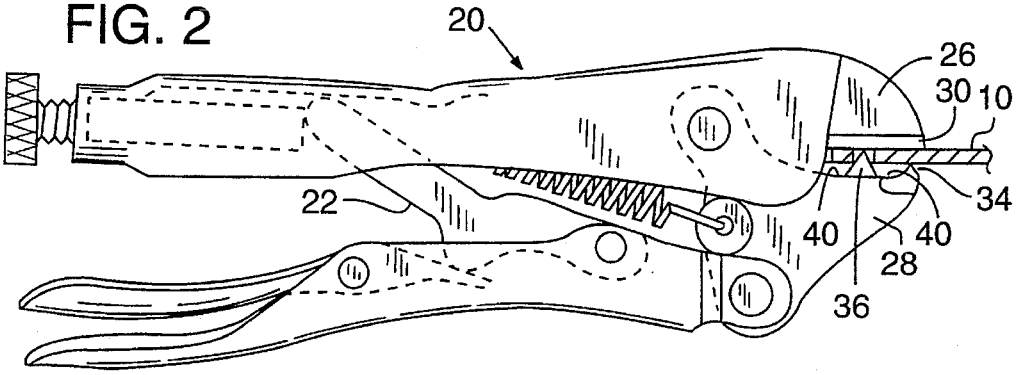
FIG. 3
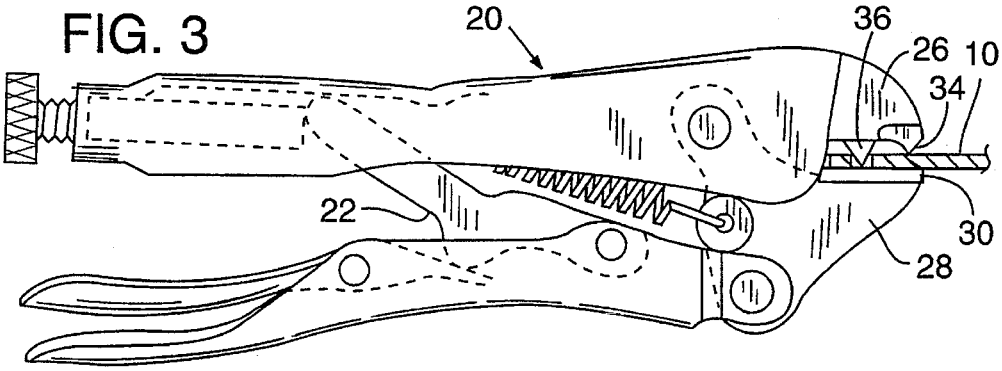

KEY HOLDING TOOL FOR LOCKSMITHS

BACKGROUND OF THE INVENTION

This invention relates to new and useful improvements in a key holding tool for locksmiths.

It is often necessary for locksmiths to fit locks with a substitute key such as when a house key, automobile key or the like has been lost. A skilled locksmith in fitting such a key grips a key blank in a tool as an extension of the tool, and through experience can feel the pattern of bitting required to impression the lock. In using such a tool, it is imperative that the key blank be held as a rigid extension of the tool. If not, the locksmith cannot get a good feel of the tumblers in the lock. In addition, any relative movement of the key and the tool will scratch or otherwise deface the head of the key.

Applicant is the owner of U.S. Pat. No. 4,136,598 directed to a plier-like tool that clamps a key blank between the forward end of a pair of jaws in an arrangement that holds the key in a forwardly projecting extension of the tool. Specifically, this prior patent relates to a tool that utilizes a first jaw that has a flat longitudinal base surface and a second jaw that utilizes a longitudinally extending sharpened projection that cuts slightly into the key blank when the jaws are clamped on a key for holding the blank in an extension of the tool.

SUMMARY OF THE INVENTION

According to the present invention an improved jaw structure is provided for a plier-like tool for holding keys that will better ensure that the key blank is locked in a rigid extension of the tool when the jaws are closed in clamped engagement on the blank. More particularly, sharpened means for holding the key blank in the tool have contact therewith in a novel manner such that the blank is positively a rigid extension of the tool. In accomplishing such object, the tool includes first and second jaws. The first jaw has a flat longitudinal anvil surface and the second jaw has a front laterally extending cutting lip directed toward the anvil surface. The cutting lip has a lateral engagement with the head portion of the key when the key is clamped in place and such lip cuts sufficiently into the metal of the head portion of the key to hold the key firmly in place. The second jaw also includes a stabilizing post that fits in the usual key ring aperture in the key. Further the tool includes an abutting edge rearward of the forward end of the jaws for additional stabilization of the key.

The invention will be better understood and additional objects and advantages will become apparent from the following description taken in connection with the accompanying drawings.

BRIEF DESCRIPTION OF THE DRAWINGS

FIG. 1 is a perspective view of the present tool and a key blank, this view illustrating the step of inserting the blank into the tool.

FIG. 2 is a side elevational view of the tool and showing a closed grip of the tool on a key blank.

FIG. 3 is a view taken similar to FIG. 2 but showing a reversal of the jaws of the tool.

FIG. 4 is a fragmentary plan view taken from between the jaws of the tool and looking up at the upper jaw as it appears in FIG. 1.

FIG. 5 Is a view similar to FIG. 4 but looking down at the lower jaw, and FIG. 6 is a perspective view of a key and a score mark that will be made by the present tool.

DETAILED DESCRIPTION OF A PREFERRED EMBODIMENT

With particular reference to the drawings, and first to FIG. 6, a conventional key 10 is shown. Such a key includes a head portion 12 and a bit or shank portion 14 provided with the usual bitting 16 (as shown in dash lines). The purpose of the present invention is to provide a tool capable of holding a key blank as an extension of the tool in an improved manner so that a proper feel of lock tumblers can be achieved to form the bitting 16. All keys have an aperture 18 in the head portion for receiving a key ring. These apertures are somewhat commonly placed on the head, namely, a fairly common distance forward of the rear edge of the head portion. That is, a distance from the rear edge of the key to the front edge of the aperture 18 will be at least 6 mm.

The invention resides primarily in the jaw structure of a tool 20 which may comprise a vise grip type pliers. As is well known this type of tool has means 22 which by suitable adjustment of an adjusting screw is capable of causing the jaws 26 and 28 of the tool to be locked tight on an article placed in the jaws. It is to be understood that other types of tools capable of clamping a pair of jaws together tightly can form a part of the invention.

According to the invention, and with reference to FIGS. 1, 2 and 4, one of the jaws 26 has a flat plate-like anvil 30 with a surface 32 that faces the other jaw. This surface comprises a flat clamping surface and preferably extends the full length of this jaw and is somewhat wider than the jaw. The other jaw 28 has a front cutting lip 34 on its tips that extends crosswise and is somewhat wider to approximate the width of anvil 30. This cutting lip is sharpened and is capable of clamping the key tightly against the surface 32 of anvil 30. The cutting lip 34, upon closure pressure of the jaws, bites into the metal of a key and assists in holding the key against rotation or any other loose movement, as will be more apparent hereinafter.

Jaw 28 has an integral post or projection 36 disposed between the lip 34 and the front of the edge **22*a* of tool pivot member 22. This post is generally pyramidal in shape and its purpose is to fit in the aperture 18 in the head portion 12 of a key and help stabilize the key blank in the jaws. Further, the post 36 is approximately centered between the front edge 22*a* of the adjacent pivot member and the cutting lip 34. This positions keys that abut against the edge 22*a* fairly accurately with the aperture 18** therein lined up over the post.

In practical application, post 36 is centered approximately 5 mm from each of edge 36 and from the lip 34. The surfaces 40 of the jaw 28 on each side of the post is sufficiently deep to allow clearance of operation of the post 36 and lip 34. The edge of cutting lip 34 is approximately 1–2 mm lower than the edge of post 36. These particular shapes and sizes are important to the function of the tool for receiving the key and clamping it between the jaws without interference and to prevent dulling of the lip on the anvil.

In mounting a key in the tool, the jaws are opened and the key blank inserted with the head portion thereof between the jaws and the post 36 projecting into the aperture in the head portion of the key blank. In most instances, the key will butt up against the edge **22*a* to assist in stabilization in addition to that provided by the key fitting on the post 36. The jaws are then closed which causes the wide cutting lip 34 to engage the one side of the key. Upon pressured closure of the jaws, the lip bites into the key and makes a slight indentation 42, FIG. 6. This wide indentation thus holds the key rigidly forwardly from the tool handle without play. Abutting of the key against the tool edge 22***a* also assists in holding the key stable in its projecting relation.

According to the present invention, a key is held in a longitudinally rigid extension of the tool with the result that the locksmith obtains a better feel for obtaining an impressioning of a particular lock.

As shown in FIG. 3, the jaws 26 and 28 can be reversed with relation to the pivot members 22 of the tool. Operation of the tool is the same.

It is to be understood that the form of my invention herein shown and described is to be taken as a preferred example of the same and that various changes in the shape, size and arrangement of parts may be resorted to without departing from the spirit of my invention, or the scope of the subjoined claims.

Having thus described my invention, I claim:

1. A key holding tool for keys having a shank portion and a flat head portion with a key ring aperture therein, said tool comprising:

a body portion, first and second jaws having forward tip ends and arranged for movement between open and closed positions, a flat longitudinal anvil surface on said first jaw leading rearwardly from said forward end and facing said second jaw, said anvil surface being arranged to engage flatwise one side of the head portion of a key, a laterally extending sharpened projection on the tip end of said second jaw directed toward said anvil surface, said sharpened projection being of a lateral dimension approximating that of said base surface and having its tip end able to cut slightly into the metal of the head portion of a key when said jaws are clamped on a key, said sharpened projection having a dimension such as to provide a lateral engagement on the head portion of the key by its tip end in substantially a full width of said base surface to cut into the key and clamp the key firmly against said anvil surface and form a rigid forward extension of the key from the tool, and an integral post on said second jaw spaced rearwardly from said sharpened projection and located to fit in the key ring aperture in the key.

2. A key holding tool for keys of the type having a shank portion and a flat head portion with a key ring aperture therein, said tool comprising:

a body portion, first and second jaws having forward ends and arranged for pivotal movement between an open position and a closed position that clamps a key in the jaws, a front abutting edge on said body portion disposed rearwardly of the forward end of said jaws, said abutting edge being engageable by the head portion of a key to form a rear stop for a key when a key is clamped in position in the jaws, a flat longitudinal anvil surface on said first jaw leading rearwardly from said forward end and facing said second jaw, said anvil surface being arranged to engage flatwise one side of the head portion of a key clamped in the jaws, a tapered integral post having a base support on said second jaw and extending toward said first jaw, a laterally extending sharpened projection on the forward end of said second jaw directed toward said anvil surface, said sharpened projection being of a lateral dimension approximating that of said base surface and having a tip arranged to cut slightly into the metal of the head portion of a key when the jaws are clamped on a key, said sharpened projection having a dimension such as to provide a lateral engagement on the head portion of the key in substantially a full width of said base surface to clamp the key firmly against said base surface and form a rigid forward extension of the key from the tool, said post having its base support in recess means of said second jaw which extend from said post to said abutting edge and from said post to said tip, said post being selectively located between the forward end of said jaws and said abutting edge and being of a selected tapered dimension so as to be received in the key ring aperture of a key with a key clamped in the jaws, said post, when a key is clamped in said jaws, engaging walls of the key ring aperture and combining with the abutment of the key against said abutting edge of the tool and the clamping engagement by the tip end of said sharpened projection on the key to form said rigid forward extension of the key from the tool.

* * * * *